US008247717B2

(12) United States Patent
Dai

(10) Patent No.: US 8,247,717 B2
(45) Date of Patent: Aug. 21, 2012

(54) POWER BUTTON ASSEMBLY AND ELECTRONIC DEVICE USING THE SAME

(75) Inventor: Bin Dai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 315 days.

(21) Appl. No.: 12/641,611

(22) Filed: Dec. 18, 2009

(65) Prior Publication Data

US 2011/0094869 A1 Apr. 28, 2011

(30) Foreign Application Priority Data

Oct. 23, 2009 (CN) ..... 2009 1 0308712

(51) Int. Cl.
*H01H 13/02* (2006.01)

(52) U.S. Cl. ..... 200/296; 200/341; 200/345; 200/520

(58) Field of Classification Search ..... 200/520, 200/296, 329–331, 341, 406, 345
See application file for complete search history.

(56) References Cited

U.S. PATENT DOCUMENTS

| | | | | |
|---|---|---|---|---|
| 4,463,237 | A * | 7/1984 | Kim | 200/345 |
| 5,391,848 | A * | 2/1995 | Murphy | 200/314 |
| 5,803,238 | A * | 9/1998 | Roza | 200/332.1 |
| 5,817,997 | A * | 10/1998 | Wernig | 200/16 R |
| 6,239,726 | B1 * | 5/2001 | Saida | 340/999 |
| 6,552,285 | B1 * | 4/2003 | Sears et al. | 200/294 |
| 6,667,447 | B2 * | 12/2003 | Liu et al. | 200/5 R |
| 6,768,070 | B2 * | 7/2004 | Lewison et al. | 200/296 |
| 7,253,370 | B2 * | 8/2007 | Chen et al. | 200/341 |
| 7,586,053 | B2 * | 9/2009 | Kim et al. | 200/296 |
| 7,820,930 | B2 * | 10/2010 | Mao | 200/343 |

* cited by examiner

*Primary Examiner* — Michael Friedhofer
(74) *Attorney, Agent, or Firm* — Altis Law Group, Inc.

(57) ABSTRACT

A power button assembly includes a printed circuit board having a switch, a support plate engaging with the printed circuit board, and a push button to activate the switch. The support plate includes abutting portions to elastically abut against the push button, and one of the support plate and the push button includes hook portions, and the other includes latching portions engaging with the hook portions.

14 Claims, 4 Drawing Sheets

POWER BUTTON ASSEMBLY AND ELECTRONIC DEVICE USING THE SAME

BACKGROUND

1. Technical Field

The present disclosure relates to a power button assembly and an electronic device using the power button assembly.

2. Description of the Related Art

An electronic device is generally provided with a power button assembly to turn a power supply on and off. A commonly used power button assembly includes a plurality of components such as a printed circuit board (PCB), a support plate, a push button, and an elastic member positioned between the push button and the PCB to generate an elastic force to abut/push against the push button. The push button may be received in an assembly hole defined in a housing of the electronic device. The PCB may engage the support plate. During assembly of the power button assembly to the housing of the electronic device, the push button is received in the assembly hole, the elastic member is positioned on one side of the push button adjacent to the PCB, and the support plate is connected to the housing to bias the elastic member to exert a set amount of elastic force acting on the push button. During assembly, the elastic member and the push button require manual positioning which are difficult to accurately control. Over time, the elastic member may loosen and no longer supply a sufficient stable elastic force to push or abut against the push button, such that the operation of the power button assembly becomes frustrated.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
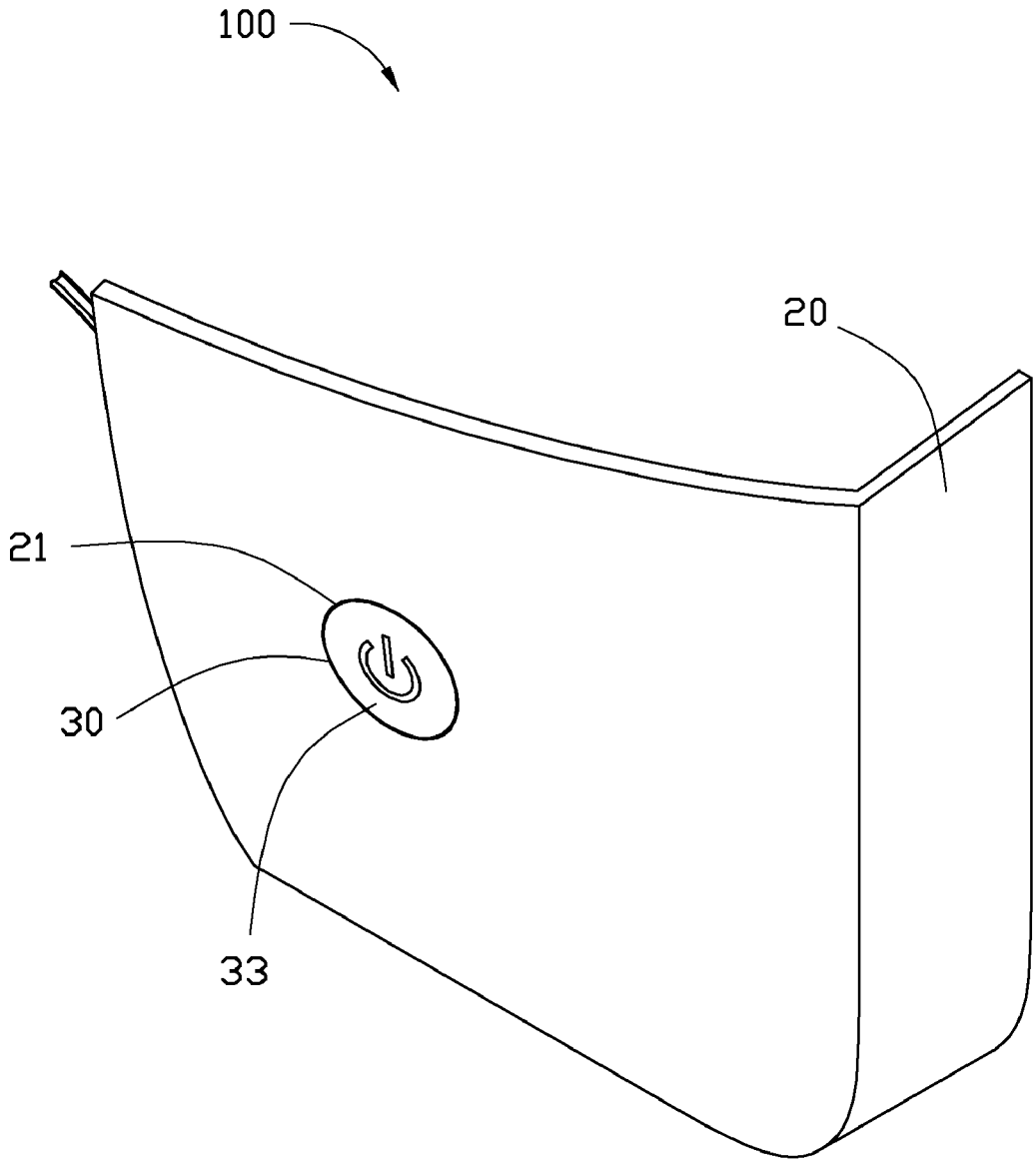
FIG. 1 is a partial, isometric view of an embodiment of an electronic device, the electronic device including an embodiment of a power button assembly.
Figure 2:
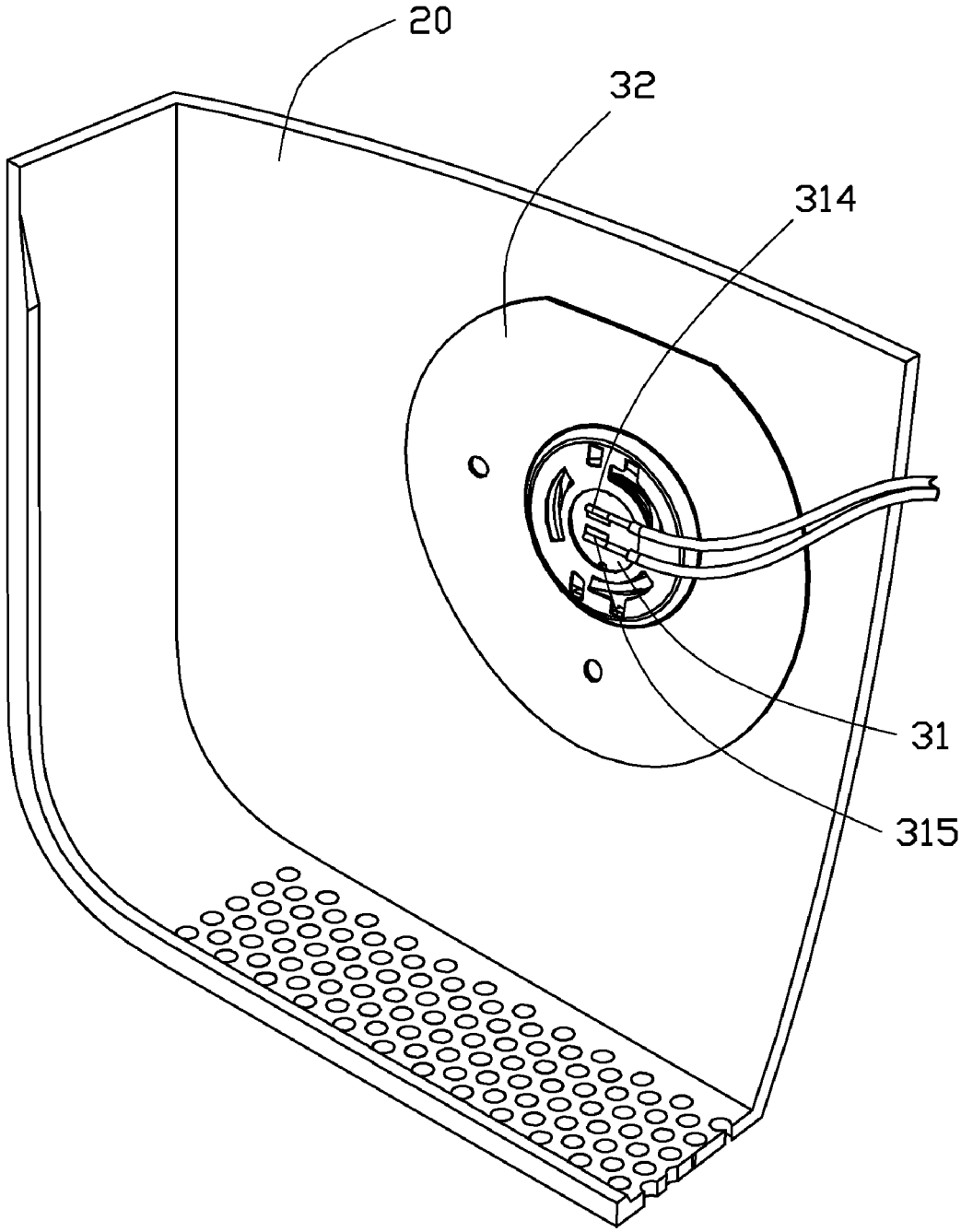
FIG. 2 is similar to FIG. 1, but is viewed from another perspective.

Referring to FIGS. 1 and 2, an embodiment of an electronic device 100 includes a housing 20 and a power button assembly 30. The housing 20 defines an assembly hole 21 therein. The electronic device 100 may be a notebook, a desktop computer, a liquid crystal display or other electronic device capable of employing the power button assembly 30.

Figure 3:
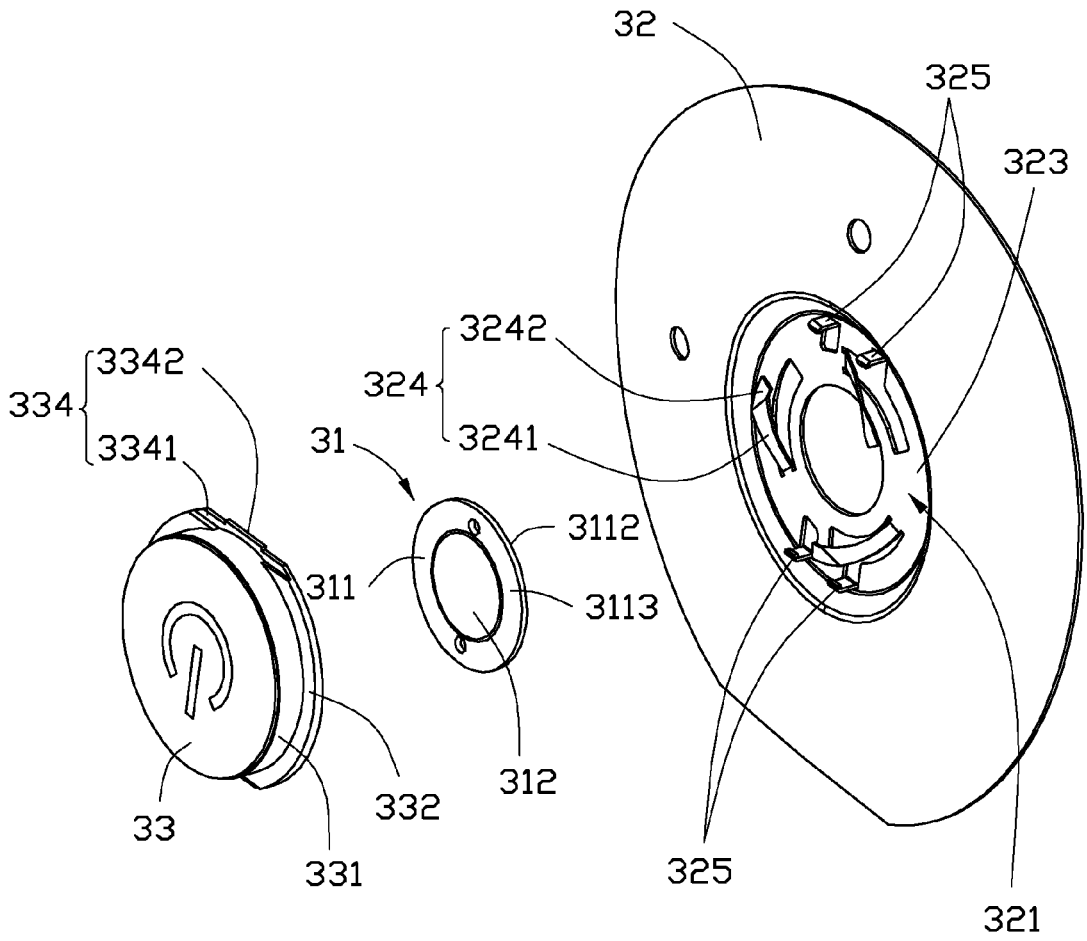
FIG. 3 is an exploded, isometric view of the power button assembly.
Figure 4:
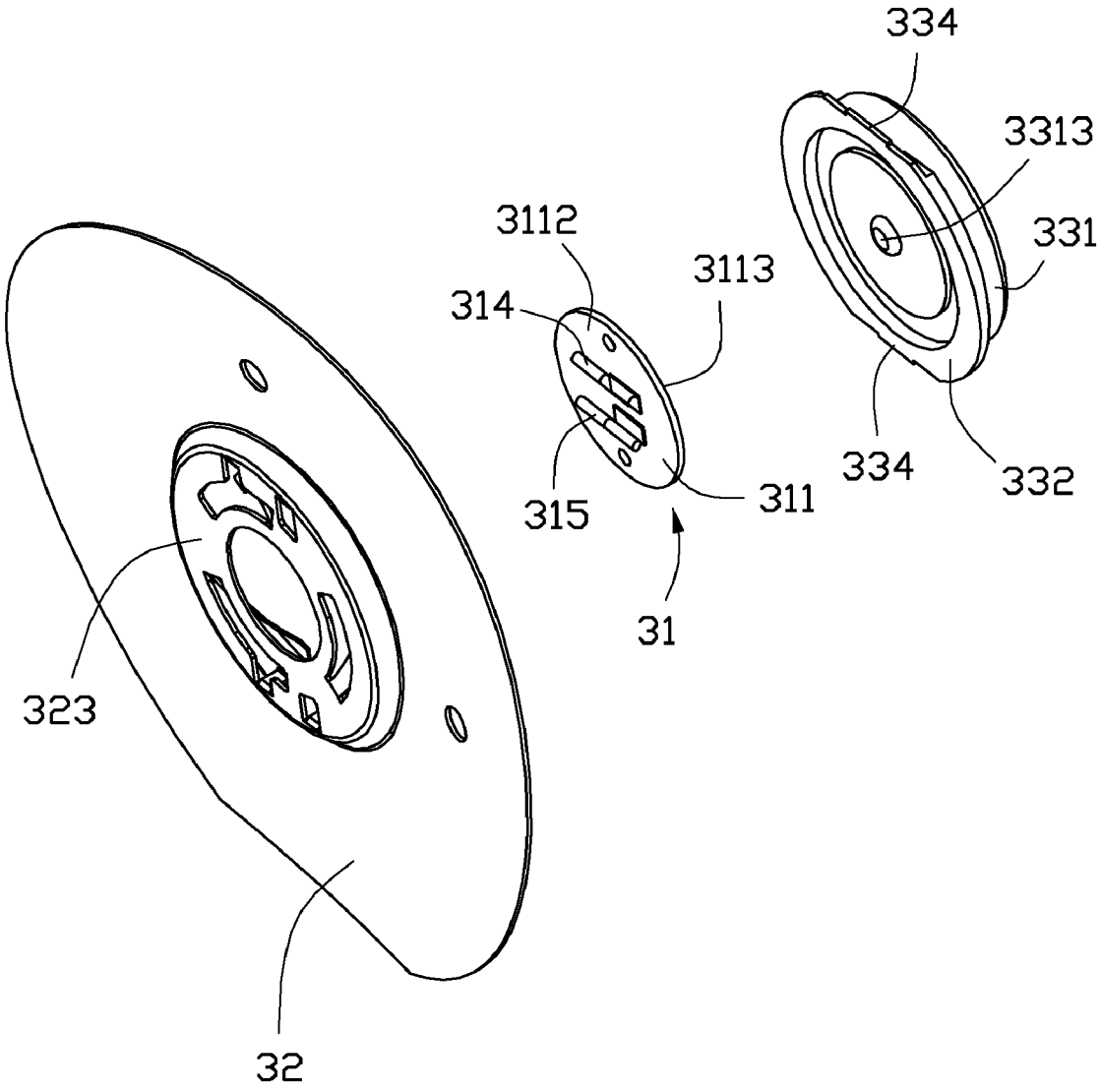
FIG. 4 is similar to FIG. 3, but is viewed from another perspective.

Referring also to FIGS. 3 and 4, the power button assembly 30 includes a PCB 31, a support plate 32, and a push button 33.

The PCB 31 includes a mainboard 311 and a switch (not labeled). The mainboard 311 includes a first surface 3112 and a second surface 3113 opposite to the first surface 3112. The switch includes a dome 312 fixed on the second surface 3113, a first electric terminal 314, and a second electric terminal 315 adjacent to the first electric terminal 314. The first and second electric terminals 314, 315 are fixed on the first surface 3112 of the mainboard 311. The dome 312 is adjacent to the ends of the first and second electric terminals 314, 315, such that when the dome 312 is elastically depressed, the first and second electric terminals 314, 315 electrically connect to each other, turning the power supply on and off.

The support plate 32 is a substantially annular metal sheet. The support plate 32 defines a depression 321 in the central region thereof to receive the push button 33. The depression 321 has a bottom wall 323 on which the mainboard 311 of the PCB 31 is fixed. The support plate 32 may be fixed to the housing 20 by double-sided adhesive or rivet.

The support plate 32 includes a plurality of abutting portions 324 and a plurality of hook portions 325 integrally formed on the bottom wall 323 thereof.

Each abutting portion 324 includes an elastic supporting arm 3241 and an abutting arm 3242 formed on a distal end of the elastic supporting arm 3241. The hook portions 325 engage with the push button 33, and the abutting arm 3242 elastically contacts the push button 33, such that the abutting portion 324 generates stable elastic force to abut/push against the push button 33. In the illustrated embodiment, the power button assembly 30 includes two pairs of hook portions 325 and three abutting portions 324. The two pairs of hook portions 325 are on opposite sides along a central axis of the bottom wall 323. The abutting portions 324 are formed on the inner circumference of the bottom wall 323 at regular intervals along the circumference. The abutting portions 324 and the hook portions 325 may be formed by punching or stamping, simplifying manufacture.

The push button 33 includes a cap 331 and a connecting portion 332 extending radially from the bottom edge of the cap 331. A contact 3313 is formed on the cap 331, and is pressed towards the dome 312 to activate the switch. Two latching portions 334 are integrally formed on the outer circumferential edge of the connecting portion 332, and the latching portions 334 are opposite to each other. Each latching portion 334 includes a stepped surface 3341 and a locking portion 3342 extending outward from the edge of the stepped surface 3341.

During the assembly of the power button assembly 30, a pair of hook portions 325 engage the stepped surface 3341 of the latching portion 334, thus connecting the push button 33 to the support plate 32, with the abutting portions 324 abutting the push button 33. The locking portion 3342 is received between two hook portions 325 to restrict the rotation of the push button 33, allowing more accurate positioning of the push button 33.

After the power button assembly 30 is assembled, the push button 33 is received in the assembly hole 21 of the housing 20, and the support plate 32 is fixed to the housing 20 by double-sided adhesive or rivet, so that the power button assembly 30 can be easily connected to the housing 20. It is unnecessary to provide dedicated hardware and manpower to assemble the power button assembly 30 in the assembly line of the electronic device 100, because the power button assembly 30 can be assembled elsewhere in advance.

In operation, as the push button 33 is depressed towards the dome 312, the contact 3313 elastically deforms the dome 312 which electrically connects the first and second electric terminals 314, 315 to turn the power supply on and off, and the abutting portions 324 are being pushed against, and thereby accumulate an elastic force. When the push button 33 is released, the elastic force is released, and the push button 33 returns to its original position, whereby the contact 3313 detaches from the dome 312 to turn the power supply on or off.

In alternative embodiments, the hook portions 325 are formed on the push button 33, and the latching portion 334 are formed on the support plate 32 to engage with the hook portions 325.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A power button assembly, comprising:

a printed circuit board comprising a switch;

a support plate engaging with the printed circuit board, the support plate defining a depression having a bottom wall, the printed circuit board received within the depression; and a push button partially assembled within the depression of the support plate and positioned above the printed circuit board for activating the switch;

the support plate comprising a plurality of abutting portions formed on the inner circumference of the bottom wall at intervals along the circumference, to surround the printed circuit board and elastically abutting against the push button; wherein one of the support plate and the push button comprises a plurality of hook portions, and the other one of the support plate and the push button comprises a plurality of latching portions engaging with the hook portions.

2. The power button assembly of claim 1, wherein the hook portions are integrally formed on the bottom wall of the support plate and positioned on opposite sides along a central axis of the bottom wall, and the latching portions are integrally formed on the outer circumferential edge of the push button and opposite to each other thereby engaging with the corresponding hook portions of the support plate.

3. The power button assembly of claim 2, wherein each latching portion comprises a stepped surface engaging with a corresponding pair of hook portions and a locking portion to restrict the rotation of the push button relative to the support plate.

4. The power button assembly of claim 1, wherein each abutting portion comprises an elastic supporting arm and an abutting arm formed on a distal end of the elastic supporting arm, and the abutting arm contacting the push button.

5. The power button assembly of claim 4, wherein the abutting portions are formed by punching and arranged in a circumferential orientation.

6. The power button assembly of claim 1, wherein the support plate is a substantially annular metal sheet and the depression is defined in the central region thereof.

7. An electronic device comprising:

a housing defining an assembly hole;

a power button assembly comprising:

a printed circuit board comprising a switch;

a support plate fixed to the housing and engaging with the printed circuit board, the support plate defining a depression having a bottom wall, the printed circuit board received within the depression;

a push button partially assembled within the depression of the support plate and positioned above the printed circuit board for activating the switch, the push button being received in the assembly hole, the support plate comprising a plurality of abutting portions formed on the inner circumference of the bottom wall at intervals along the circumference, to surround the printed circuit board and elastically abutting against the push button, wherein one of the support plate and the push button comprises a plurality of hook portions, and the other one of the support plate and the push button comprises a plurality of latching portions engaging with the hook portions.

8. The power button assembly of claim 7, wherein the hook portions are integrally formed on the bottom wall of the support plate and positioned on opposite sides along a central axis of the bottom wall, and the latching portions are integrally formed on the outer circumferential edge of the push button and opposite to each other thereby engaging with the corresponding hook portions of the support plate.

9. The electronic device of claim 7, wherein each latching portion comprises a stepped surface engaging with the corresponding pair of hook portions and a locking portion to restrict the rotation of the push button relative to the support plate.

10. The electronic device of claim 7, wherein each abutting portion comprises an elastic supporting arm and an abutting arm formed on a distal end of the elastic supporting arm, and the abutting arm contacting the push button.

11. The electronic device of claim 7, wherein the abutting portions are formed by punching and arranged along a circumferential axis.

12. The electronic device of claim 7, wherein the support plate is fixed on the housing by double-sided adhesive.

13. The electronic device of claim 7, wherein the printed circuit board comprises a mainboard having a first surface and an opposite second surface, the mainboard is fixed to the bottom wall of the depression; the switch comprises a dome fixed on the second surface, a first electric terminal, and a second electric terminal adjacent to the first electric terminal; the first and second electric terminals are fixed on the first surface of the mainboard, the dome is adjacent to the ends of the first and second electric terminals, such that when the dome is elastically depressed, the first and second electric terminals electrically connect to each other.

14. The electronic device of claim 7, wherein the push button comprises a cap and a connecting portion extending radially from the bottom edge of the cap, a contact is formed on the cap, and is capable of being pressed towards the dome to activate the switch; the latching portions are integrally formed on the outer circumferential edge of the connecting portion, and the latching portions are opposite to each other.

* * * * *